US006178708B1

(12) United States Patent
Porter

(10) Patent No.: US 6,178,708 B1
(45) Date of Patent: Jan. 30, 2001

(54) METAL-FACED ANGLED SPLINE FOR USE WITH STRUCTURAL INSULATED PANELS

(76) Inventor: William H. Porter, P.O. Box 249, Saugatuck, MI (US) 49453

( * ) Notice: Under 35 U.S.C. 154(b), the term of this patent shall be extended for 0 days.

(21) Appl. No.: 09/159,261

(22) Filed: Sep. 23, 1998

(51) Int. Cl.[7] ..... E04B 7/00

(52) U.S. Cl. ..... 52/272; 52/273; 52/288.1; 52/462; 52/467; 52/640

(58) Field of Search ..... 52/288.1, 462, 52/467, 640, 273, 272, 90.1, 90.2

(56) References Cited

U.S. PATENT DOCUMENTS

| | | | | |
|---|---|---|---|---|
| 919,057 | * | 4/1909 | Moore | 52/288.1 |
| 1,250,594 | * | 12/1917 | Knapp | 52/288.1 |
| 2,111,922 | * | 3/1938 | Borkenstein | 52/273 |
| 3,557,840 | * | 1/1971 | Maybee | 138/149 |
| 3,654,053 | * | 4/1972 | Toedter | 161/43 |
| 3,731,449 | * | 5/1973 | Kephart | 52/631 |
| 3,911,554 | * | 10/1975 | Ford | 29/527.2 |
| 4,024,684 | * | 5/1977 | Holmgren | 52/127 |
| 4,402,170 | * | 9/1983 | Seidner | 52/631 |
| 4,430,833 | * | 2/1984 | Balzer et al. | 52/288.1 |
| 4,704,837 | * | 11/1987 | Menchetti et al. | 52/273 |
| 4,932,171 | * | 6/1990 | Beattie | 52/273 |
| 5,428,929 | * | 7/1995 | Reese | 52/288.1 |

* cited by examiner

*Primary Examiner*—Beth A. Stephan
*Assistant Examiner*—Dennis L. Dorsey
(74) *Attorney, Agent, or Firm*—Emrich & Dithmar

(57) ABSTRACT

A spline for joining two adjacent structural insulated panels each having an insulating core disposed between and joined to first and second outer facings includes a backer member attached to a metal strip by a conventional coupler such as an adhesive. The backer member and metal strip form an elongated, linear combination, and the outer surface of the backer member may be provided with a groove or slot extending the length thereof. The backer member slot facilitates bending or folding the backer plate and metal strip combination along the length thereof into two connected sections for use as a spline. The angled spline is used for connecting adjacent panels which may be oriented at a relative angle $\alpha$, where $\alpha>0°$, by placing each section of the spline in intimate contact with a respective panel along the lengths thereof. Conventional connectors such as screws or nails are inserted through each panel and its associated spline section to connect adjacent panels. In one embodiment, the angled spline is positioned in abutting contact with and attached to each of the inner and outer facings of a pair of connected panels to increase the strength of the joint. The backer member may be comprised of any of the more common building materials such as wood or a gypsum or cement composite.

15 Claims, 4 Drawing Sheets

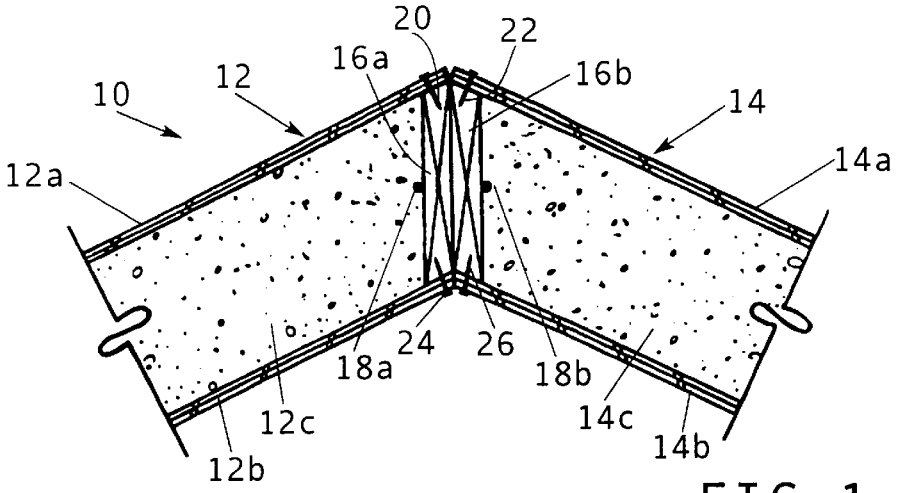
FIG. 1
(PRIOR ART)
FIG. 2
(PRIOR ART)
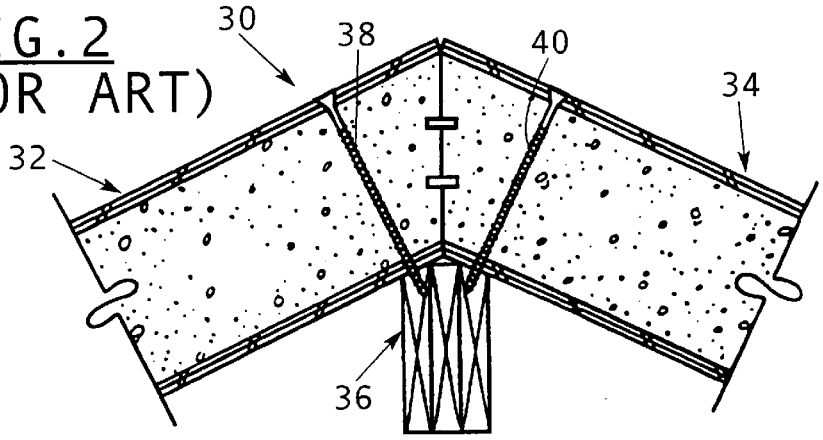
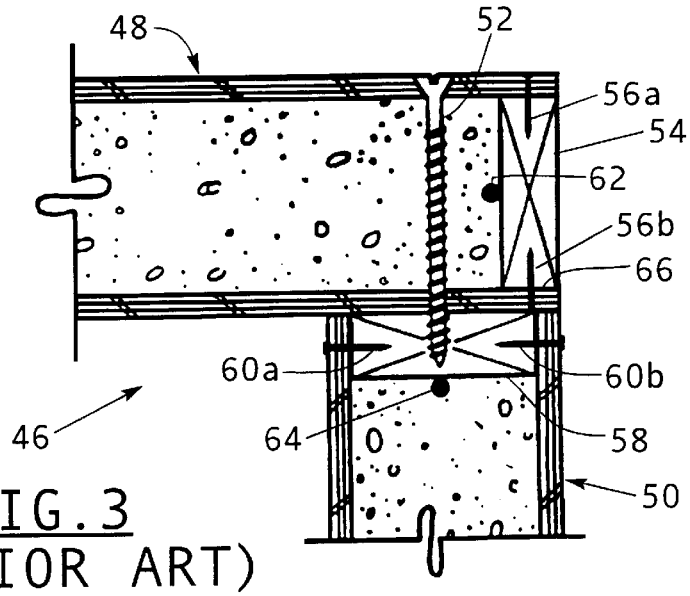
FIG. 3
(PRIOR ART)

METAL-FACED ANGLED SPLINE FOR USE WITH STRUCTURAL INSULATED PANELS

FIELD OF THE INVENTION

This invention relates generally to structural panels for buildings and is particularly directed to the joinder of structural insulated panels having an insulating core where the joined panels may be oriented at virtually any angle relative to one another.

BACKGROUND OF THE INVENTION

Structural Insulated Panels (SIPs) are commonly used in building construction and are comprised of two outer rigid faces on either side of a light insulating foam core. Panels of this type are generally joined by means of lumber and nails, but are increasingly connected using steel studs rather than the conventional 2× dimensional lumber approach. The junctures of such panels typically employ a lumber spline with nails and screws for joining.

Referring to FIG. 1, there is shown a sectional view of a prior art panel coupling arrangement 10 for connecting adjacent first and second structural insulated panels 12 and 14 which are oriented with an obtuse angle between the planes of each of the panels. The relative orientation of the first and second panels 12,14 is such as would be encountered in the ridge of a roof. The first structural insulated panel 12 includes first and second outer facings 12*a* and 12*b* and an insulating core 12*c* disposed between and attached to each of the outer facings. Similarly, the second panel 14 includes first and second opposed outer facings 14*a* and 14*b* and an insulating core 14*c* disposed between and affixed to the two outer facings. The outer facings of each of the panels may be comprised of any of the more conventional construction materials such as wood, waferboard, sheet metal, gypsum, or oriented strand board (OSB). Each of the insulating cores 12*c* and 14*c* is preferably comprised of a plastic foam such as expanded polystyrene (EPS), extruded polystyrene (XPS) or polyurethanes or polyisocyanurates. Each of the outer facings is securely bonded to its inner rigid foam core by conventional means such as mastic, epoxy cement or urethane glue. As shown in the prior art panel coupling arrangement 10 of FIG. 1, the ends of the insulating cores 12*c* and 14*c* of the first and second panels 12,14 have been omitted or removed from the edge of the panel. This permits adjacent edges of the first and second panels 12,14 to each receive a respective panel support beam 16*a* and 16*b* between the outer facings of the panel. First and second sealant beads or strips 18*a* and 18*b* are respectively positioned between beam 16*a* and insulating core 12*c* and between beam 16*b* and insulating core 14*c*. The first and second panels 12,14 are respectively attached to panel support beams 16*a* and 16*b* by means of upper connectors 20 and 22, and lower connectors 24 and 26. Each of the connectors 20,22,24 and 26 is in the form of either a nail or screw and is inserted through an outer facing of a panel and into one of the panel support beams. Thus, connectors 20 and 24 are respectively inserted through outer facings 12*a* and 12*b* and into panel support beam 16*a*. Similarly, connectors 22 and 26 are respectively inserted through outer facings 14*a* and 14*b* and into panel support beam 16*b*.

Referring to FIG. 2, there is shown a sectional view of another common prior art coupling arrangement 30 for connecting adjacent structural insulated panels 32 and 34 such as in forming the ridge of a roof. Adjacent edges of the first and second panels 32,34 are positioned on a ridge beam 36. First and second threaded connectors 38 and 40 are respectively inserted through the first and second panels 32 and 34 and into ridge beam 36.

Another prior art panel coupling arrangement 30 for connecting first and second structural insulated panels 48 and 50 which are oriented at 90° relative to one another is shown in the sectional view of FIG. 3. The panel coupling arrangement 46 shown in FIG. 3 is typical of a connection between adjacent corner wall panels. Adjacent ends of the first and second panels 48,50 are hollowed out, or are provided with a channel, to respectively receive wood splines 54 and 58. The first wood spline 54 is attached to the outer facings of the first panel 48 by means of connectors 56*a* and 56*b*. Similarly, the second wood spline 58 is connected to the outer facings of the second panel 50 by means of connectors 60*a* and 60*b*. Sealant beads 62 and 64 are respectively positioned on the first and second wood splines 54 and 58 between the wood spline and its associated insulating core, and extend the length of the wood spline. A threaded coupler 52 is inserted through the end of the first panel 48 and into the second wood spline 58 of the second panel 50 as shown in FIG. 3 for connecting the two panels.

The panel coupling arrangements described above involve the use of substantial amounts of lumber which increased the cost of the installation. These prior art panel coupling arrangements also frequently require the ripping of lumber to special angles in the field, particularly in the case of pitched roofs, which also increases the cost and complexity of the installation. In some cases, the lumber spline is in contact with the outer and inner facings of the panel and acts as a through-conductor for heat resulting in energy loss. In addition, the panel corner coupling arrangement of FIG. 3 is not easily adapted to receive electrical wiring around the corner. Access holes must be cut or drilled in at least two wood splines to accommodate electrical wiring around the corner. Finally, the aforementioned panel coupling arrangements employ connectors such as nails and screws extending through plastic panel facings and into wood splines and beams which affords only limited joint strength.

The present invention addresses the aforementioned limitations of the prior art by providing a metal faced angled spline for use in connecting adjacent structural insulated panels arranged at virtually any relative angular orientation in forming a high strength, sealed joint.

OBJECTS AND SUMMARY OF THE INVENTION

Accordingly, it is an object of the present invention to provide a metal reinforced joint for connecting adjacent structural insulated panels as used in roofs, ceilings, walls or floors.

It is another object of the present invention to securely join adjacent structural insulated panels oriented at virtually any relative angle.

Yet another object of the present invention is to provide a metal-faced flexible spline for use in connecting adjacent structural insulated panels which may be configured in the field for the specific panel arrangement in which it is to be used.

A further object of the present invention is to provide a metal reinforced composite gypsum or cement joint for joining structural insulated panels which is impervious to moisture, fire resistant, of high strength, and makes use of readily available construction materials.

This invention contemplates a coupling arrangement for connecting first and second structural insulated panels each having a respective insulating core and first and second outer facings attached to opposed sides of the insulating core in forming a planar structure, wherein the first and second panels are arranged in edge-abutting contact and form an angle a therebetween, where $\alpha>0°$, the coupling arrangement comprising: an elongated linear spline comprised of a metal strip and a backer member affixed to each other along the lengths thereof, wherein the metal strip and backer member are adapted for folding along the lengths thereof so as to form first and second spline sections having an angle $\beta$ therebetween, where $\alpha=\beta$; and coupling means for connecting the first and second spline sections to respective edge portions of adjacent outer facings of the first and second panels.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIGS. 1 and 2 are partial sectional views showing two different prior art arrangement for coupling adjacent structural insulated panels such as in a roof ridge;

FIG. 3 is a partial sectional view showing a prior art coupling arrangement for adjacent structural insulated panels oriented at 90° to one another such as used in connecting corner wall sections;

DETAILED DESCRIPTION OF THE PREFERRED EMBODIMENTS

Figure 4:
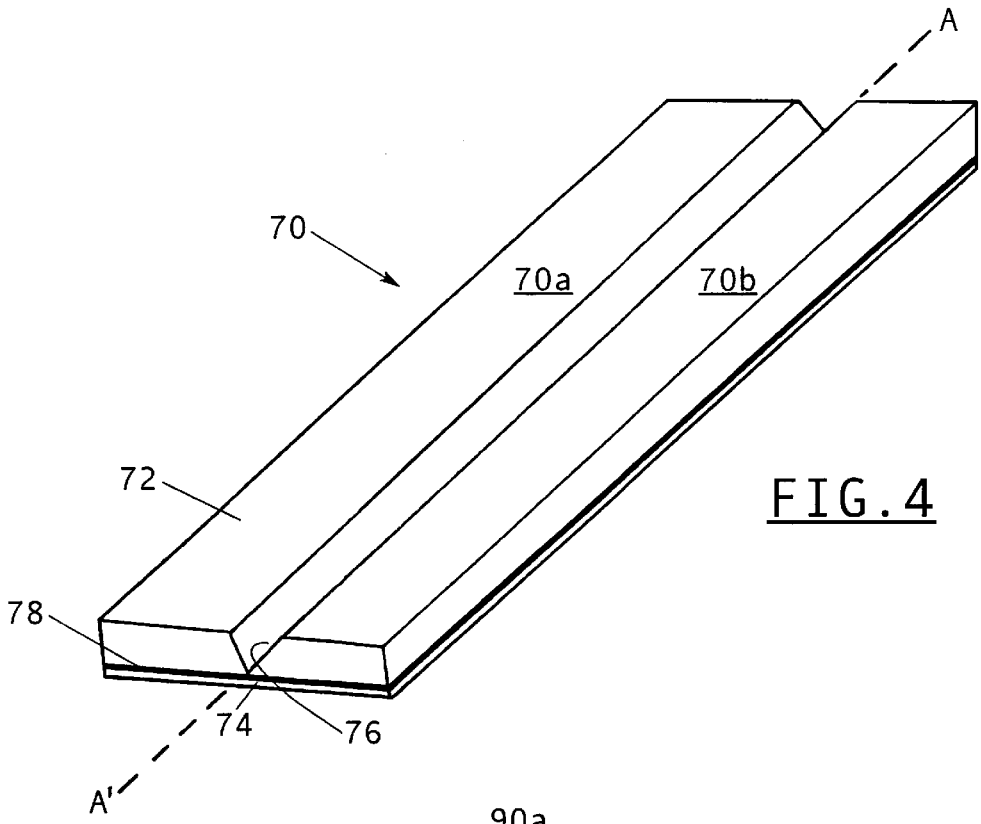
FIG. 4 is a perspective view of a metal-faced spline used in connecting adjacent structural insulated panels in accordance with the present invention.

Referring to FIG. 4, there is shown a perspective view of a spline 70 for connecting adjacent structural insulated panels in accordance with the principles of the present invention. Spline 70 is rectangular and generally flat in shape and includes a backing member 72 and a metal facing 74. Backing member 72 and metal facing 74 are affixed to each other by means of an adhesive layer 78 disposed therebetween. Backing member 72 may be comprised of any of the more conventional building materials such as wood or gypsum or cement composite material. Metal facing 74 is in the form of a thin sheet and is preferably comprised of a high strength metal such as steel or aluminum. Adhesive layer 78 may be comprised of any of the more conventional adhesive materials such as epoxy cement, urethane glue or mastic. Disposed within and extending the length of backing to member 72 is an elongated, linear slot or groove 76 extending the length of spline 70. Slot 76 facilitates folding of spline 70 along its longitudinal axis A–A' (shown in FIG. 4 in dotted line form). In a preferred embodiment, slot 76 is generally V-shaped and extends through backing member 72 to the inner surface of the metal facing 74. Slot 76 divides spline 70 into first and second spline sections 70*a* and 70*b* which may be folded relative to one another along axis A–A' and placed in contact with respective adjacent structural insulated panels as described in detail below. In a typical installation, spline is 5" wide, ⅝" thick and 96" long, although spline is not limited to these specific dimensions.

Figure 5:
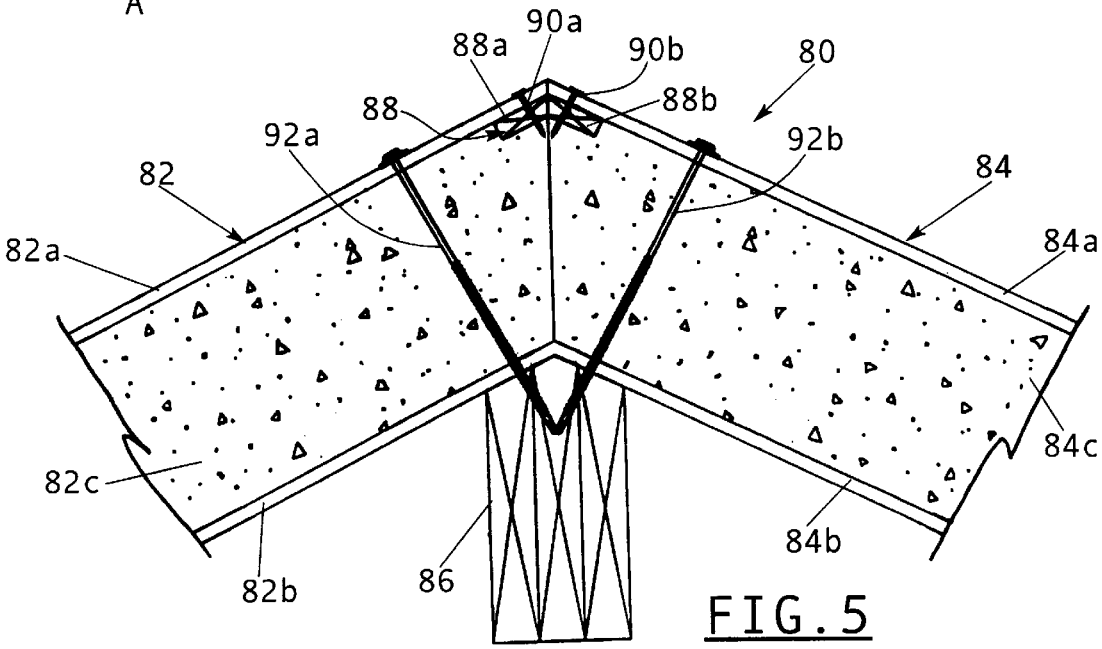
FIG. 5 is a partial sectional view showing a panel coupling arrangement in accordance with one embodiment of the present invention.

Referring to FIG. 5, there is shown a partial sectional view of a panel coupling arrangement 80 in accordance with one embodiment of the present invention. Panel coupling arrangement 80 connects first and second structural insulated panels 82 and 84 together as well as to a ridge beam 86. As in the previously described arrangements, the first panel 82 includes first and second outer facings 82*a* and 82*b* and an insulating core 82*c* disposed between and attached to each of the outer facings by means of an adhesive layer which is not shown in the figure for simplicity. Similarly, the second panel 84 includes first and second opposed outer facings 84*a* and 84*b* and an insulating core 84*c* disposed between and affixed to each of the outer facings. First and second threaded connectors 92*a* and 92*b* are inserted through the outer facings and insulating cores of the first and second panels 82 and 84, respectively. Each of the threaded connectors 92*a* and 92*b* is further inserted into the ridge beam 86 for securely attaching the first and second panels 82,84 to the ridge beam. A metal-faced angled spline 88 in accordance with the present invention is positioned in engagement with adjacent inner portions of the outer facings 82*a* and 84*a* of the first and second panels 82, 84. As shown in the figure, spline 88 is bent so as to conform with the relative angular orientation of the outer facings 82*a*, 84*a* of the first and second panels 82, 84. The metal facing 88*a* of spline 88 is placed in contact with the aforementioned outer facings of the joined panels and the spline's backing member 88*b* is placed in contact with the respective insulating cores 82*c* and 84*c* of the joined panels. Each of the insulating cores 82*c* and 84*c* of the two panels may be provided with a respective cut-out portion as shown in the figure to receive a respective section of spline 88. A slot in spline 88 similar to that in the spline shown in FIG. 4 allows the spline to be folded so as to conform with the relative angular orientation of the facings 82*a* and 84*a* of the first and second panels 82,84. First and second connectors 90*a* and 90*b* are respectively inserted through outer facings 82*a* and 84*a* and through spline 88 to securely connect the spline to the first and second panels 82, 84. Connectors 90*a* and 90*b* may be conventional such as screws or nails. Spline 88 preferably extends the full length of the joint between the first and second panels 82,84. Similarly, spline 88 may be of virtually any width so long as the two spline sections formed when the spline is folded can be securely affixed to the respective outer facings of the first and second panels 82,84. Spline 88 may be folded to the required angle either in the field immediately before application to the joined panels or may be pre-bent to the desired angle at the factory following manufacture.

Figure 6:
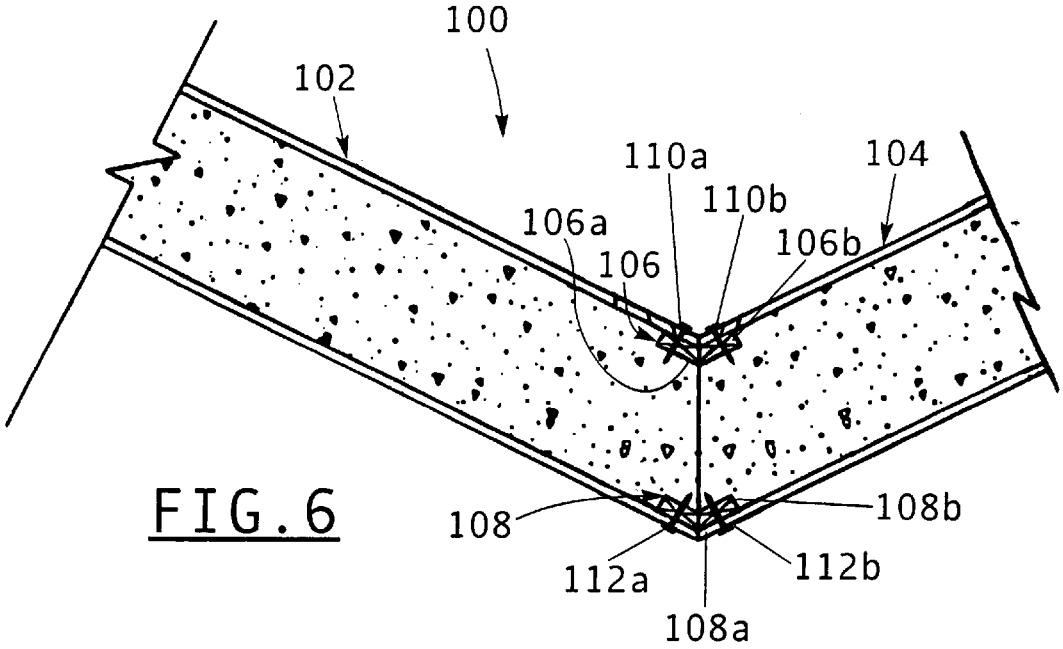
FIG. 6 is a partial sectional view showing a panel coupling arrangement in accordance with another embodiment of the present invention.

Referring to FIG. 6, there is shown another panel coupling arrangement for connecting first and second structural insulated panels 102 and 104 which form a roof valley. The construction of each of the first and second panels 102,104 is the same as those previously described and will not be further discussed herein. In joining the first and second panels 102,104, a first metal faced angled spline 106 is placed in contact with and connected to the upper outer facings of these two panels, while a second metal faced angled spline 108 is placed in contact with and connected to a lower pair of outer facings of the two panels. In the case of the first spline 106, its backing member 106*b* is placed in contact with the inner edge portions of the outer facings of the first and second panels 102, 104. Metal facing 106*a* of spline 106 is placed in contact with the insulating core of the two panels. In the case of the second spline 108, its metal facing 108*a* is placed in contact with the outer facings of the first and second panels 102,104, while its backing member 108*b* is placed in contact with the insulating cores of these panels. A first pair of connectors 11*a* and 110*b* are inserted through adjacent edges of the outer facings of the panels 102,104 and through respective sections of the first spline 106 for securely connecting the spline to the two panels. Similarly, third and fourth connectors 112*a* and 112*b* are inserted through edge portions of opposed outer facings of the two panels and through respective sections of the second spline 108 to securely connect the spline to each of the first and second panels 102,104.

Figure 7:
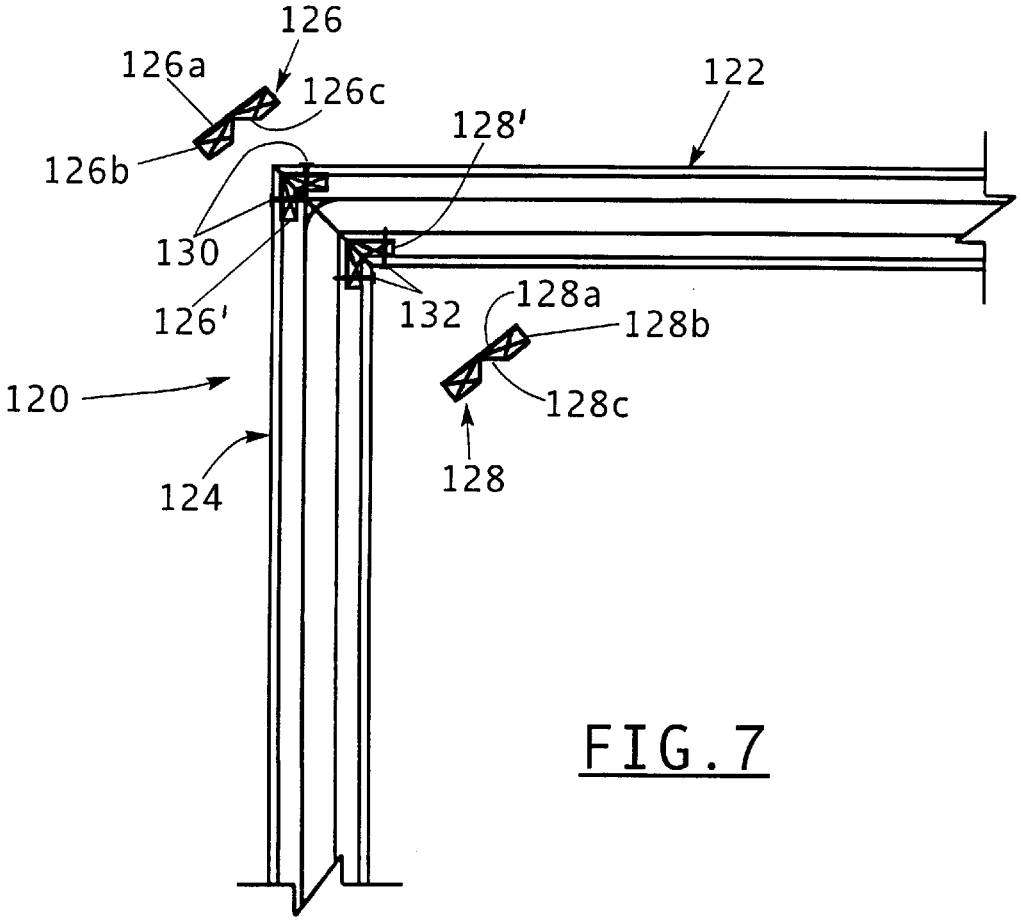
FIG. 7 is a partial sectional view showing the coupling of two structural insulated panels oriented at 90° relative to one another such as encountered in wall corner connections in accordance with another embodiment of the present invention.

Referring to FIG. 7, there is shown a partial sectional view of a panel coupling arrangement 120 for coupling two structural insulated panels 122 and 124 oriented at 90° relative to one another such as encountered in wall corner connections in accordance with another embodiment of the present invention. As in the previously described arrangements, each of the first and second panels 122,124 includes an inner insulating core and first and second outer opposed facings. A first metal faced angled spline 126 is shown adjacent the panel coupling arrangement 120 and is shown incorporated in the panel coupling arrangement as element 126'. Similarly, a second metal faced angled spline 128 is shown adjacent the panel coupling arrangement 120 and is also shown as element 128' as incorporated in the panel coupling arrangement. As in the previously described embodiments, the first spline 126 includes a metal facing 126*a*, a backing member 126*b* and a slot 126*c* in the backing member. Similarly, the second spline 128 includes a metal facing 128*a*, a backing member 126*b* and a slot 126*c* within the backing member. In the arrangement shown in FIG. 7, the sections of each of the first and second splines 126' and 128' are oriented at 90° when inserted in the panel coupling arrangement 120. The metal facing 126*a* of the first metal faced angled spline 126 is disposed in contact with a first pair of adjacent outer facings of first and second panels 122 and 124. Similarly, the backing member 128*b* of the second spline 128 is disposed in contact with a second, opposed pair of outer facings of panels 122 and 124. A first pair of connectors 130 couple the first spline 126' to the panels' outer facings, while a second pair of connectors 132 connect the second spline 128' to the opposed pair of outer facings of the two panels. The orientation of the first and second splines in FIGS. 6 and 7 shows that the spline's metal facing may engage the panels' inner or outer facings.

Figure 8:
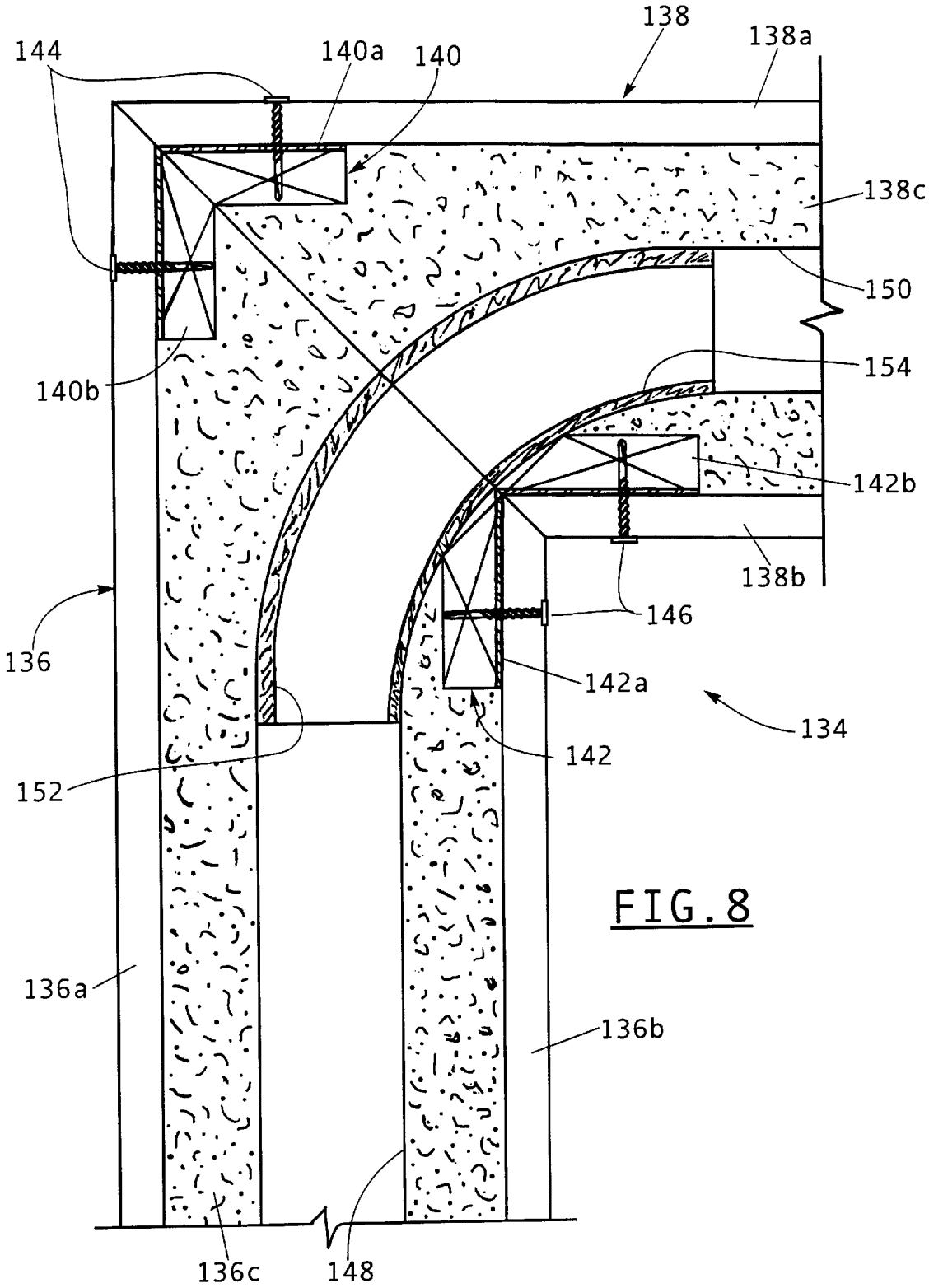
FIG. 8 is a partial sectional view showing the manner in which electrical access is provided around a 90° corner using the metal-faced angled splines of the present invention for connecting a pair of adjacent structural insulated panels.

Referring to FIG. 8, there is shown a partial sectional view of yet another panel coupling arrangement 134 in accordance with the principles of the present invention. Panel coupling arrangement 134 connects first and second structural insulated panels 136 and 138 which are oriented at 900 relative to one another such as encountered in wall corner connections. The first panel 136 includes first and second outer facings 136*a* and 136*b* and an inner insulating core 136*c*. Similarly, the second panel 138 includes first and second outer facings 138*a* and 138*b* and an inner insulating core 138*c*. Disposed within the insulating core 136*c* of the first panel 136 is an elongated, linear channel 148, while disposed within the insulating core 138*c* of the second panel 138 is a second elongated, linear channel 150. Also disposed within the first panel 136 and continuous with the linear channel 148 therein is a curvilinear channel 152. Similarly, disposed within the second panel 138 and continuous with its linear channel 150 is a curvilinear channel 154. Adjacent edges of the first and second panels 136,138 are bevelled so that the two panels form a 90° angle when placed in edge-abutting contact as shown in the figure. With the two panels disposed in edge-abutting contact, the curvilinear channels 152 and 154 of the two panels are in common alignment also as shown in the figure. With the first and second panels 136,138 arranged in edge-abutting contact so their respective channels are aligned, the two linear channels 148 and 154 and the two curvilinear channels 152 and 154 form a continuous chase for carrying electrical wiring within the two adjoining panels.

The first and second panels 136,138 are securely joined together in edge-abutting contact by means of first and second metal faced angled splines 140 and 142. The first spline 140 includes a metal facing 140*a* and a backing member 140*b*, while the second spline 142 also includes a metal facing 142*a* and a backing member 142*b*. To form the first spline 140 in the shape shown in FIG. 8, the spline is bent in a direction of a slot in the spline's backing member 140*b*. Conversely, the second spline 142 is bent away from a slot in the spline's backing member 142*b* so that the two spline sections are placed in contact with respective adjacent edges of outer facings 136*b* and 138*b* of panels 136 and 138. A first pair of threaded connectors 144 connect the first spline 140 to the two panels, while a second pair of threaded connectors 146 connect the second spline 142 to the two panels. The electrical chase formed in the two coupled panels 136,138 is formed without cutting through panel attachment and supporting splines as in the prior art approach discussed above.

There has thus been shown a spline for joining two adjacent structural insulated panels. The spline includes a thin metal strip attached to a backing member which may have a slot therein. The slot extends the length of the spline and facilitates folding of the spline to form first and second coupled spline sections. Each spline section is attached to adjacent edge portions of the outer facings of the coupled panels by conventional connectors such as nails or screws. The two spline sections may be angularly oriented relative to one another so as to match the angle of intersection of the two connected panes which permits the metal faced angled spline to connect adjacent, edge-abutting panels which may be oriented at virtually any relative angle. The spline's backing member may be wood, a gypsum or cement composite material, or other conventional building material. The use of a gypsum or cement composite with the metal strip provides a fire resistant spline for joining adjacent panels at the weakest point in terms of the spread of fire in structural insulated panel construction. The gypsum/metal or cement/metal spline is effective in blocking fire at the panel joint. The metal strip provides the gypsum or cement composite spline with substantially increased strength and greater screw or power driven fastener holding power which gypsum or cement lacks by itself. Screws or power driven fasteners are easily and securely driven into a metal faced composite gypsum or cement spline.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawing is offered by way of illustration only and not as a limitation. The actual scope of the invention is intended to be defined in the following claims when viewed in their proper perspective based on the prior art.

I claim:

1. A coupling arrangement for connecting building panels comprising:

first and second structural insulated panels each having a respective insulating core and first and second outer facings attached to opposed sides of said insulating core in forming a planar structure, wherein said first and second panels are arranged in edge-abutting contact and form an angle a therebetween where $\alpha>0°$;

an elongated linear spline comprised of a metal strip and a backer member affixed to each other along the lengths thereof, wherein said metal strip and backer member are adapted for folding along the lengths thereof so as to form first and second spline sections having an angle $\beta$ therebetween, where $\alpha=\beta$, said backer member including slot means extending the length thereof for facilitating folding of the spline along said slot means in forming said first and second spline sections; and coupling means for connecting said first and second spline sections to respective edge portions of adjacent outer facings of said first and second panels.

2. The coupling arrangement of claim 1 wherein said slot is V-shaped.

3. The coupling arrangement of claim 2 wherein said slot extends through said backer member to said metal strip.

4. The coupling arrangement of claim 1 wherein said backer member is comprised of wood or a gypsum composite or cement composite material.

5. The coupling arrangement of claim 4, wherein said metal strip is comprised of steel or aluminum.

6. The coupling arrangement of claim 1 further comprising connecting means for affixing said metal strip to said backer member.

7. The coupling arrangement of claim 6 wherein said connecting means comprises a high strength adhesive.

8. The coupling arrangement of claim 7 wherein said high strength adhesive is epoxy cement, urethane glue or mastic.

9. The coupling arrangement of claim 1 wherein said coupling means includes screws or nails.

10. The coupling arrangement of claim 1 wherein said backer member is disposed in contact with the inner edge portions of said adjacent outer facings of said first and second panels.

11. The coupling arrangement of claim 1 wherein said metal strip is disposed in contact with the inner edge portions of adjacent outer facings of said first and second panels.

12. The coupling arrangement of claim 1 comprising first and second elongated linear splines each comprised of a respective metal strip and a backer member affixed to each other along the lengths thereof, and wherein each spline is adapted for folding along the respective lengths thereof so as to form first and second spline sections in each of said first and second splines, and wherein said coupling means connects the first and second sections of said first spline to adjacent edge portions of said first outer facings of said first and second panels and connects the first and second sections of said second spline to adjacent edge portions of said second outer facings of first and second panels, wherein said first and second panels form a corner.

13. The coupling arrangement of claim 1 wherein each insulating core of said first and second structural insulated panels includes a respective pre-cut slot for receiving in a tight-fitting manner a respective spline section.

14. The coupling arrangement of claim 13 further comprising first and second curvilinear channels in adjacent portions of the insulating cores of the first and second structural insulated panels forming a continuous chase for carrying electrical wiring within the panels around the corner formed by the panels.

15. The coupling arrangement of claim 14 wherein the first and second panels and the first and second sections of said first and second splines are oriented at 90° relative to each other.

* * * * *

UNITED STATES PATENT AND TRADEMARK OFFICE

CERTIFICATE OF CORRECTION

PATENT NO. : 6,178,708 B1
DATED : January 30, 2001
INVENTOR(S) : Porter

It is certified that error appears in the above-identified patent and that said Letters Patent is hereby corrected as shown below:

In the Detailed Description of the Preferred Embodiments

Column 5,
Line 62, delete "900" insert "90°"

Signed and Sealed this

Twenty-first Day of August, 2001

*Attest:*

Nicholas P. Godici

NICHOLAS P. GODICI
*Acting Director of the United States Patent and Trademark Office*

*Attesting Officer*